US007051426B2

(12) United States Patent
Buswell

(10) Patent No.: US 7,051,426 B2
(45) Date of Patent: May 30, 2006

(54) METHOD MAKING A CUTTING DISK INTO OF A SUBSTRATE

(75) Inventor: Shen Buswell, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 378 days.

(21) Appl. No.: 10/661,868

(22) Filed: Sep. 12, 2003

(65) Prior Publication Data

US 2004/0055145 A1 Mar. 25, 2004

Related U.S. Application Data

(63) Continuation-in-part of application No. 10/061,492, filed on Jan. 31, 2002.

(51) Int. Cl.
*H05B 3/00* (2006.01)
*B24B 1/00* (2006.01)
*B24C 1/00* (2006.01)

(52) U.S. Cl. ..... 29/611; 29/729; 29/890.1; 451/38; 451/37; 451/36

(58) Field of Classification Search ..... 29/611, 29/729, 890.1; 347/65, 62, 54, 92; 451/36, 451/38, 37, 58, 57
See application file for complete search history.

(56) References Cited

U.S. PATENT DOCUMENTS 4,721,977 A 1/1988 Fukae
4,746,935 A 5/1988 Allen
4,887,100 A 12/1989 Michaelis et al.
5,081,063 A 1/1992 Vonno et al.
5,160,403 A 11/1992 Fisher et al.
5,250,084 A * 10/1993 Lansell et al. ..... 51/293
5,266,528 A 11/1993 Yamada
5,369,060 A 11/1994 Baumann et al.
5,387,314 A 2/1995 Baughman et al.
5,391,236 A 2/1995 Krut et al.
5,408,739 A 4/1995 Altavela et al.
5,441,593 A 8/1995 Baughman et al.
5,455,998 A 10/1995 Miyazono et al.
5,578,418 A 11/1996 Noguchi et al.
5,658,471 A 8/1997 Murthy et al.
5,678,290 A 10/1997 Good
5,818,481 A 10/1998 Hotomi et al.
5,825,076 A 10/1998 Kotvas et al.
5,921,846 A * 7/1999 Katz ..... 451/28
5,998,234 A 12/1999 Murata et al.
6,007,415 A * 12/1999 Van Osenbruggen ..... 451/488
6,041,501 A 3/2000 Suzuki et al.
6,074,048 A 6/2000 Hotomi et al.
6,113,225 A 9/2000 Miyata et al.

(Continued)

FOREIGN PATENT DOCUMENTS

EP 0430593 6/1991

(Continued)

OTHER PUBLICATIONS

British Patent Office Search Report Under Section 17—GB0301949.4.

*Primary Examiner*—A. Dexter Tugbang
*Assistant Examiner*—Tai Nguyen

(57) ABSTRACT

The described embodiments relate to methods and systems of forming slots in a substrate. One exemplary embodiment forms a feature into a substrate having a first substrate surface and a second substrate surface, and moves a sand drill nozzle along the substrate to remove substrate material sufficient to form, in combination with said forming, a slot through the substrate.

12 Claims, 9 Drawing Sheets

U.S. PATENT DOCUMENTS

| | | | |
|---|---|---|---|
| 6,117,347 | A | 9/2000 | Ishida |
| 6,139,132 | A | 10/2000 | Yasukawa et al. |
| 6,143,190 | A | 11/2000 | Yagi et al. |
| 6,238,269 | B1 | 5/2001 | Pollard et al. |
| 6,241,335 | B1 | 6/2001 | Suzuki |
| 6,267,904 | B1 | 7/2001 | Silverbrook |
| 6,271,102 | B1 | 8/2001 | Brouillette et al. |
| 6,286,938 | B1 | 9/2001 | Okano et al. |
| 6,291,317 | B1 | 9/2001 | Salatino et al. |
| 6,312,612 | B1 | 11/2001 | Sherman et al. |
| 6,318,844 | B1 | 11/2001 | Witteveen et al. |
| 6,345,885 | B1 | 2/2002 | Lin et al. |
| 6,412,921 | B1 | 7/2002 | Manini |
| 6,467,876 | B1 | 10/2002 | Karasawa et al. |
| 2003/0095166 | A1 | 5/2003 | Tan et al. |
| 2003/0140497 | A1 | 7/2003 | Rivas et al. |
| 2003/0164355 | A1 | 9/2003 | Park |

FOREIGN PATENT DOCUMENTS

| | | |
|---|---|---|
| EP | 0609012 | 8/1994 |
| EP | 0764533 | 3/1997 |
| EP | 1138491 | 10/2001 |
| GB | 2384752 | 8/2003 |
| GB | 2384753 | 8/2003 |
| GB | 0420178.6 | 11/2004 |
| JP | 110198387 | 7/1999 |

* cited by examiner

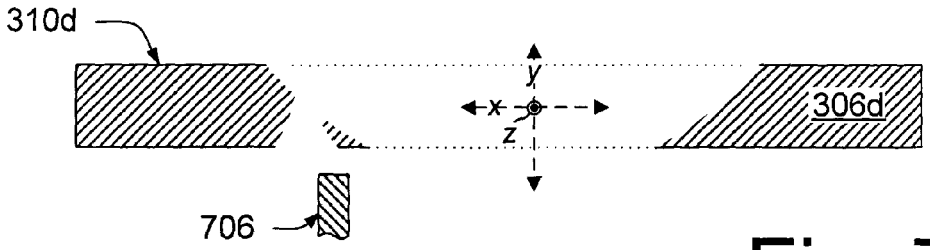
Fig. 7e
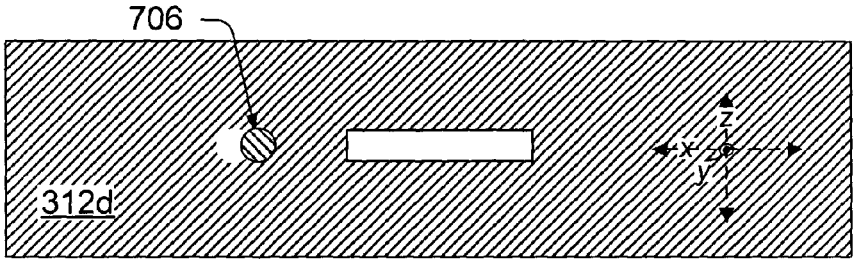
Fig. 7f
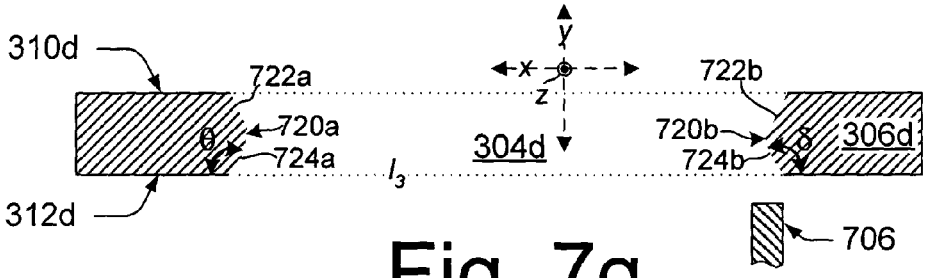
Fig. 7g
Fig. 7h
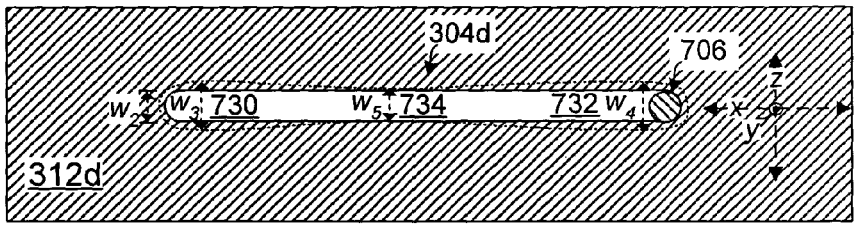
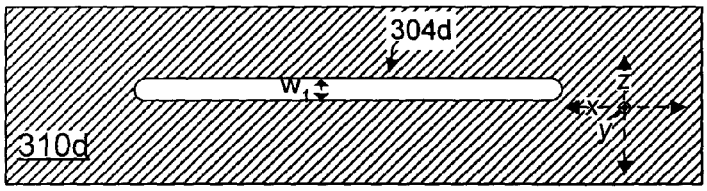
Fig. 7i
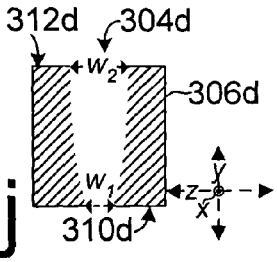
Fig. 7j

METHOD MAKING A CUTTING DISK INTO OF A SUBSTRATE

This application is a continuation-in-part and claims priority from a U.S. patent application Ser. No. 10/061,492, filed on Jan. 31, 2002, entitled Methods and Systems for Forming Slots in a Semiconductor Substrate.

BACKGROUND

Fluid-ejecting devices such as print heads often incorporate a slotted substrate in their construction. It is desirable to form slotted substrates having fluid-handling slots positioned closely together on the substrate. Some current slotting techniques cannot produce slots as close together as desired. Other existing technologies produce slotted substrates having a high failure rate due to cracking. For these and other reasons, there is a need for the present invention.

BRIEF DESCRIPTION OF THE DRAWINGS

The same components are used throughout the drawings to reference like features and components.

FIGS. 7*a*, 7*c*, 7*e* 7*g* and 7*j* illustrate cross-sectional views of a substrate in accordance with one exemplary embodiment.

FIGS. 7*b*, 7*d*, 7*f*, 7*h* and 7*i* illustrate elevational views of a substrate in accordance with one exemplary embodiment.

DETAILED DESCRIPTION OF THE PREFERRED EMBODIMENTS

The embodiments described below pertain to methods and systems for forming slots in a substrate, such as a semiconductor substrate. One embodiment of this process will be described in the context of forming fluid-feed slots in a print head die substrate.

Fluid-feed slots ("slots") can be formed in various ways. In some embodiments, a slot is formed, at least in part, by forming a feature into the substrate. As used herein, the term "feature" can comprise a 'through feature' which passes all the way through a portion of the substrate's thickness, such as a "slot". Other satisfactory embodiments may form a 'blind feature' which passes through less than the entire thickness, such as a trench, among others. In one exemplary embodiment, a feature can be formed in a substrate by making a saw cut with a circular saw from a first side or surface of the substrate. A feature formed in this manner may have a tapered elevational profile.

Some exemplary embodiments can also remove substrate material from a generally opposite second surface of the substrate with abrasive particles directed at portions of the substrate. In some of these embodiments, the abrasive particles are delivered from a sand drill nozzle. In some embodiments, the sand drill nozzle is positioned at a first portion of the substrate's second surface and then subsequently at a second different portion. In some of these embodiments, the nozzle is moved along the feature at a rate corresponding to the feature's tapered elevational profile.

The combination of cutting and removing can remove substrate material to form a slot having a desired profile through the substrate in some embodiments. Slots made this way can be very narrow and as long as desired. Narrow slots result from the removal of less substrate material than wider slots of a given length and as such may be faster to form and/or result in beneficial strength characteristics of the slotted substrate that can reduce die fragility. This, in turn, can allow slots to be positioned closer together on the die.

Although exemplary embodiments described herein are described in the context of providing dies for use in inkjet printers, it should be recognized and understood that the techniques described herein can be applicable to other applications where slots are desired to be formed in a substrate.

The various components described below may not be illustrated accurately as far as their size is concerned. Rather, the included figures are intended as diagrammatic representations to illustrate to the reader various inventive principles that are described herein.

Figure 1:
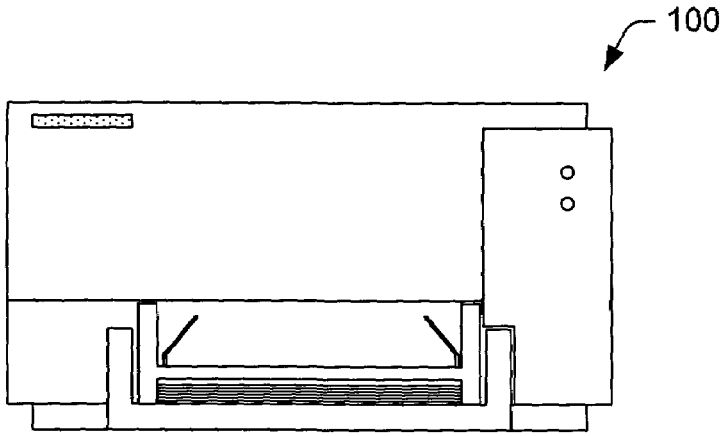
FIG. 1 illustrates a front elevational view of an exemplary printer.

FIG. 1 illustrates an exemplary printing device that in this embodiment comprises a printer 100. The printer shown here is embodied in the form of an inkjet printer. The printer 100 can be capable of printing in black-and-white and/or color. The term "printing device" refers to any type of printing device and/or image forming device that employs a slotted substrate to achieve at least a portion of its functionality. Examples of such printing devices can include, but are not limited to, printers, facsimile machines, photocopiers, and the like.

Figure 2:
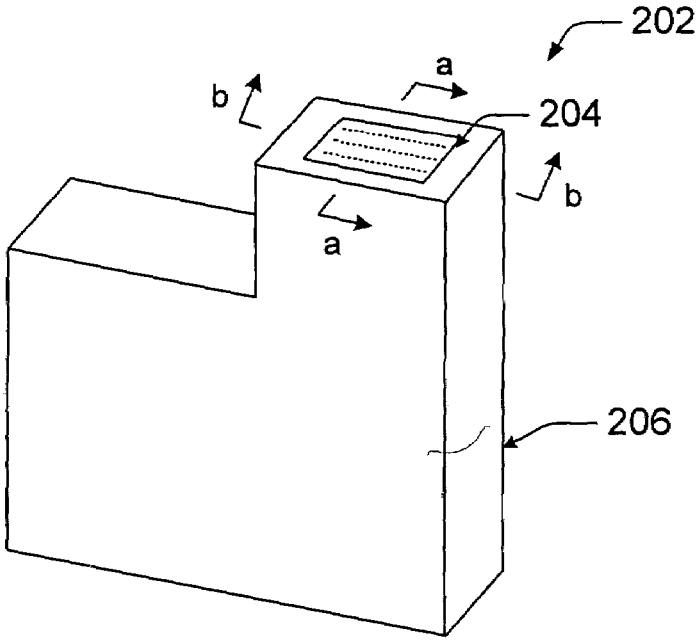
FIG. 2 illustrates a perspective view of an exemplary print cartridge suitable for use in at least some exemplary printing devices in accordance with one exemplary embodiment.

FIG. 2 illustrates an exemplary print cartridge or pen 202 that can be used in an exemplary printing device such as printer 100. The print cartridge 202 is comprised of a print head 204 and a cartridge body 206. While a single print head is shown on print cartridge 202, other print cartridges may have multiple print heads on a single print cartridge. Some suitable print cartridges can be disposable, while others can have a useful lifespan equal to or exceeding that of the printing device. Other exemplary configurations will be recognized by those of skill in the art.

The various print heads described above and below provide examples of exemplary micro electro mechanical systems devices ("MEMS devices") or fluid ejecting devices. Suitable MEMS devices will be recognized by the skilled artisan.

Figure 3:
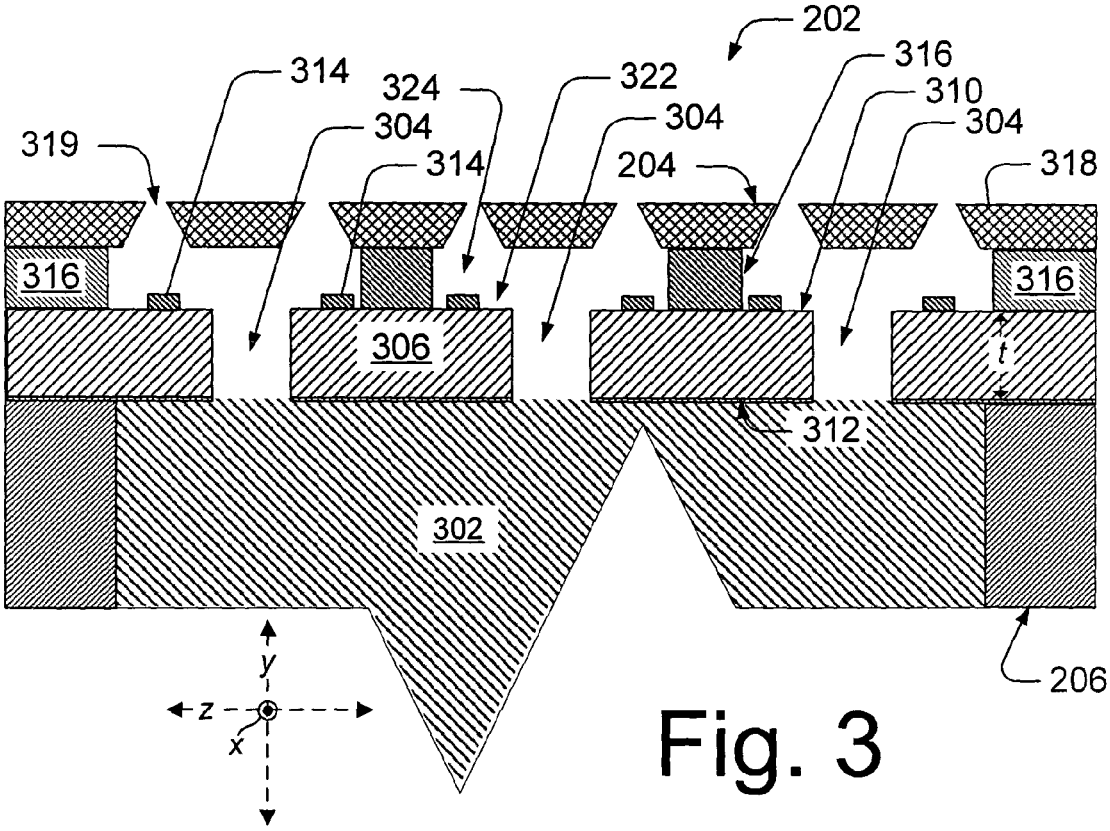
FIG. 3 illustrates a cross-sectional view of a portion of a print cartridge in accordance with one exemplary embodiment.

FIG. 3 illustrates a cross-sectional representation taken along line a—a of a portion of the exemplary print cartridge 202 as shown in FIG. 2. FIG. 3 shows the cartridge body 206 containing fluid or ink 302 for supply to print head 204. In this embodiment, the print cartridge is configured to supply one color of fluid or ink to the print head. In this embodiment, a number of different slots 304 supply ink 302 for ejecting from print head 202. This view shows a short axis of the slots which is transverse a long axis extending into and out of the page.

Other printing devices can utilize multiple print cartridges each of which can supply a single color or black ink. In some embodiments, other exemplary print cartridges can supply multiple colors and/or black ink to a single print head. For example, other exemplary embodiments can divide the fluid supply so that each of the three slots 304 receives a separate fluid supply. Other exemplary print heads can utilize less or more slots than the three shown here.

Slots 304 pass through portions of substrate 306. In this exemplary embodiment, silicon can be a suitable substrate. In some embodiments, substrate 306 comprises a crystalline substrate such as monocrystalline silicon. Examples of other suitable substrates include, among others, gallium arsenide, glass, silica, ceramics, or a semi-conducting material. The substrate can comprise various configurations as will be recognized by one of skill in the art.

Substrate 306 has a first surface 310 separated by a thickness t from a second surface 312. The described embodiments can work satisfactorily with various thicknesses of substrate. For example, in some embodiments, the thickness t can range from less than about 100 microns to at least about 2000 microns. The thickness t of the substrate in one exemplary embodiment can be about 675 microns. Other exemplary embodiments can be outside of this range.

As shown in FIG. 3, print head 204 further comprises independently controllable fluid drop generators positioned over the substrate 306. In some embodiments, the fluid drop generators comprise firing resistors 314. In this exemplary embodiment, the firing resistors 314 are part of a stack of thin film layers positioned over the substrate's first surface 310. For this reason, the first surface is often referred to as the thin-film side or thin-film surface.

A barrier layer 316 can be positioned over the thin-film layers. The barrier layer 316 can comprise, among other things, a photo-resist polymer substrate. In some embodiments, above the barrier layer is an orifice plate 318. In one embodiment, the orifice plate comprises a nickel substrate. In another embodiment, the orifice plate is the same material as the barrier layer. Orifice plate 318 can have a plurality of nozzles 319 through which fluid heated by the various firing resistors 314 can be ejected for printing on a print media (not shown). The various layers can be formed, deposited, or attached upon the preceding layers. The configuration given here is but one possible configuration. For example, in an alternative embodiment, the orifice plate and barrier layer are integral.

The exemplary print cartridge shown in FIGS. 2 and 3 is upside down from the common orientation during usage. When positioned for use, fluid can flow from the cartridge body 206 into one or more of the slots 304. From the slots, the fluid can travel through a fluid-feed passageway 322 that leads to an ejection or firing chamber 324 that can be defined, at least in part, by the barrier layer 316. An ejection chamber can be comprised of a firing resistor 314, a nozzle 319, and a given volume of space therein. Other configurations are also possible.

FIGS. 4*a*–4*c*, 5*a*–5*d* and 6*a*–6*c* represent a portion of cross-sections oriented along line b—b indicated in FIG. 2. These figures illustrate several exemplary methods of removing substrate material with a circular saw to form a feature in a substrate. FIGS. 7*a*, 7*c* and 7*e* show similar cross-sectional views. FIGS. 7*a*–7*h* show an example of how additional substrate material can be removed to form a desired slot configuration in the substrate.

Figure 4A:
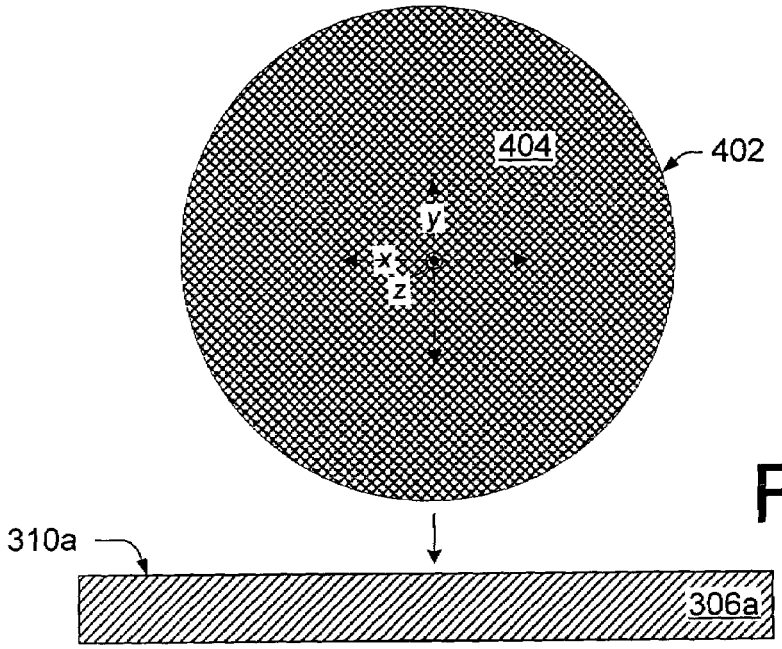
FIGS. 4*a*–4*c*, 5*a*–5*d* and 6*a*–6*b* illustrate cross-sectional views of an exemplary substrate in accordance with one exemplary embodiment.

FIG. 4*a* illustrates a circular cutting disk or saw 402 positioned above a first surface 310*a* of a substrate 306*a*. In the present embodiment, as depicted in FIG. 4*a*, the circular saw can have a generally planar surface 404 that is oriented generally perpendicularly to first surface 310*a* of the substrate. Circular saw 402 is capable of spinning in a clockwise or counterclockwise direction about an axis of rotation. Other suitable embodiments can spin in one direction and reverse to spin in the other direction or a combination thereof.

Suitable circular saws can have a blade comprising diamond grit, or other suitable material. Suitable circular saws can be obtained from Disco and KNS, among others. Exemplary saw blades can have diameters ranging from less than about ¼ of an inch to more than 2 inches. One particular embodiment uses a saw blade having a diameter of about ½ inch. Saw blade widths can range from less than 30 microns to more than 200 microns.

As positioned, the saw can be lowered along the y-axis to contact the substrate. The saw can continue to be lowered through the substrate to a desired depth. The cut made by this vertical movement of the saw is commonly called a chop or plunge cut.

Figure 4B:
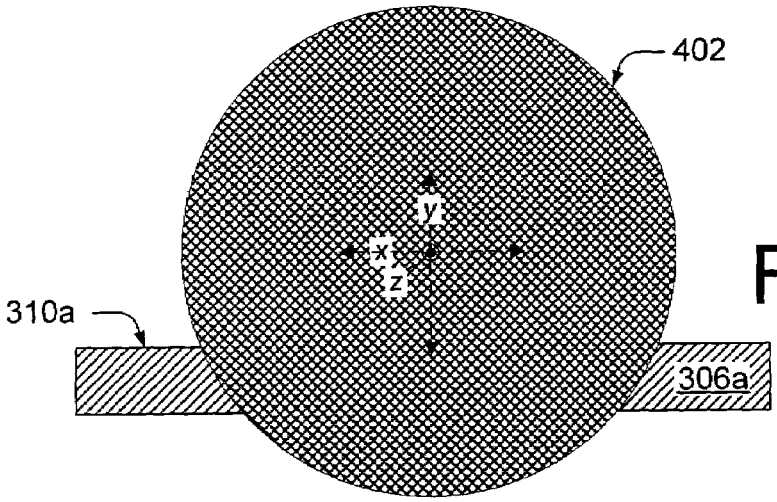
Figure 4C:
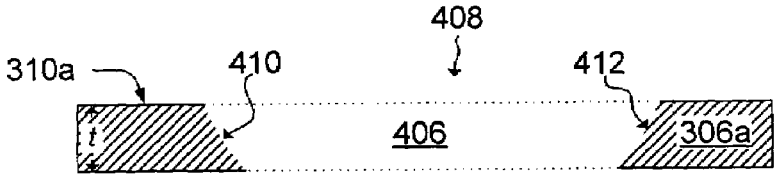

FIG. 4*b* illustrates an exemplary embodiment where circular saw 402 has been lowered along the y-axis so as to pass all of the way through a portion of the substrate 306*a* to form a feature 406 which is designated in FIG. 4*c*. The saw can then be withdrawn along the y-axis.

FIG. 4*c* illustrates feature 406 after the saw is removed from the substrate. In the embodiment shown in FIG. 4*c*, feature 406 has a tapered elevational profile indicated generally at 408 and comprised of tapered portions 410, 412. Feature profiles will be discussed in more detail below in relation to FIG. 7*a*.

FIGS. 5*a*–5*d* illustrate another embodiment where a saw 402*b* can form a feature in a substrate 306*b*. The substrate is defined, at least in part, by first and second surfaces 310*b*, 312*b*.

Figure 5A:
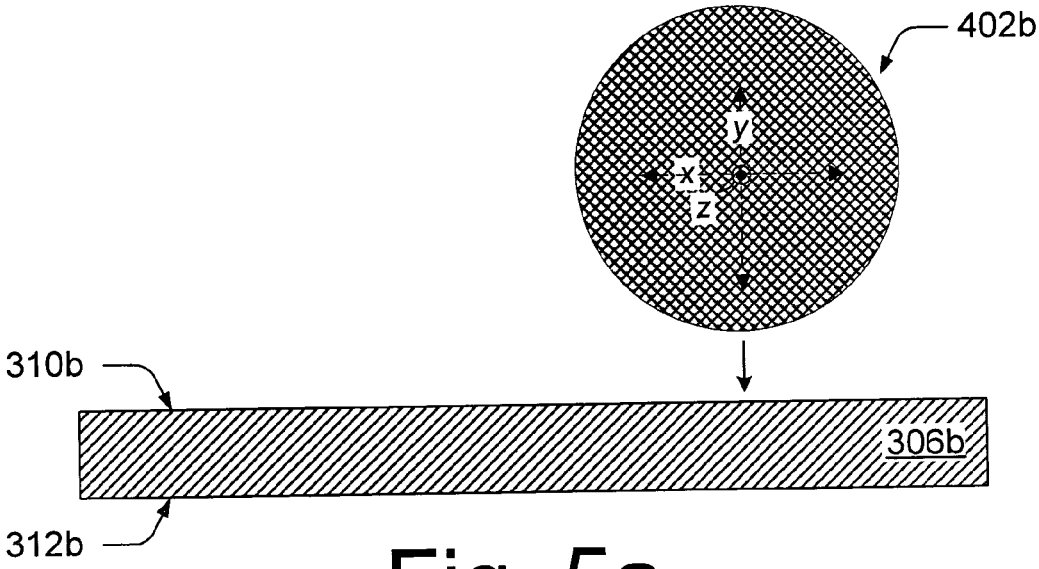

FIG. 5*a* illustrates the circular saw 402*b* positioned above the substrate so that the saw can be lowered along the y-axis to contact the substrate. The saw can continue to be lowered through the substrate to a desired depth.

Figure 5B:
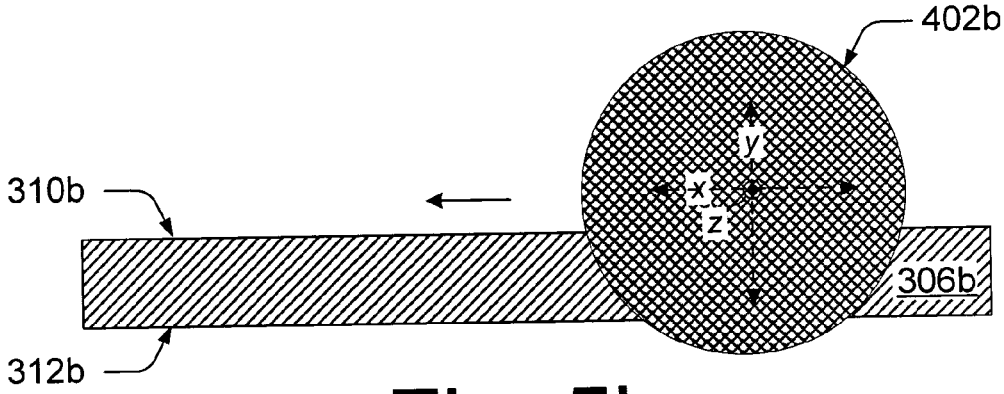

FIG. 5*b* illustrates an exemplary embodiment where the saw has been lowered along the y-axis until the saw passes all of the way through the substrate 306*b*. Other exemplary embodiments can cut through less than the entire thickness of the substrate, and/or make multiple passes to cut the desired thickness. Regardless of the depth cut, the saw can then be moved along the x-axis in contact with the substrate for a desired distance. This is commonly referred to as a drag cut. When the saw has reached the desired distance along the x-axis, it can be moved in the opposite direction along the y-axis to cease contact with the substrate.

Figure 5C:
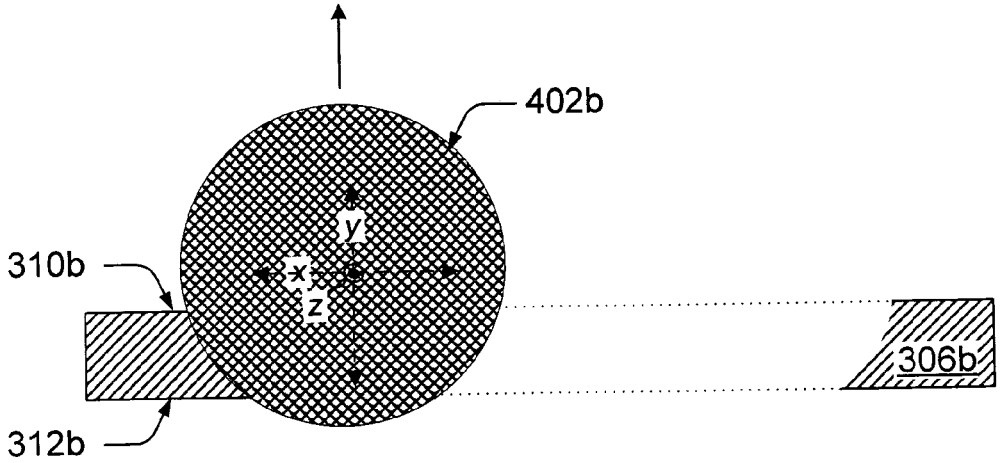

For example, FIG. 5*c* illustrates the saw having reached the desired distance in the x direction or axis. The saw can now be moved along the y-axis away from the substrate.

Figure 5D:
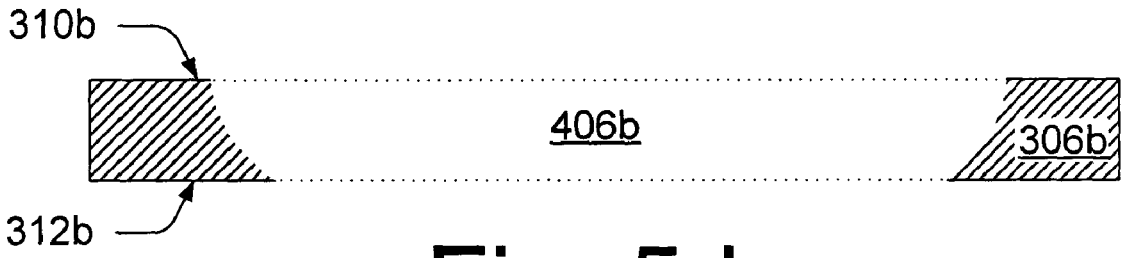

FIG. 5*d* illustrates feature 406*b* formed in substrate 306*b* after the cutting performed in FIGS. 5*a*–5*c*.

Figure 6A:
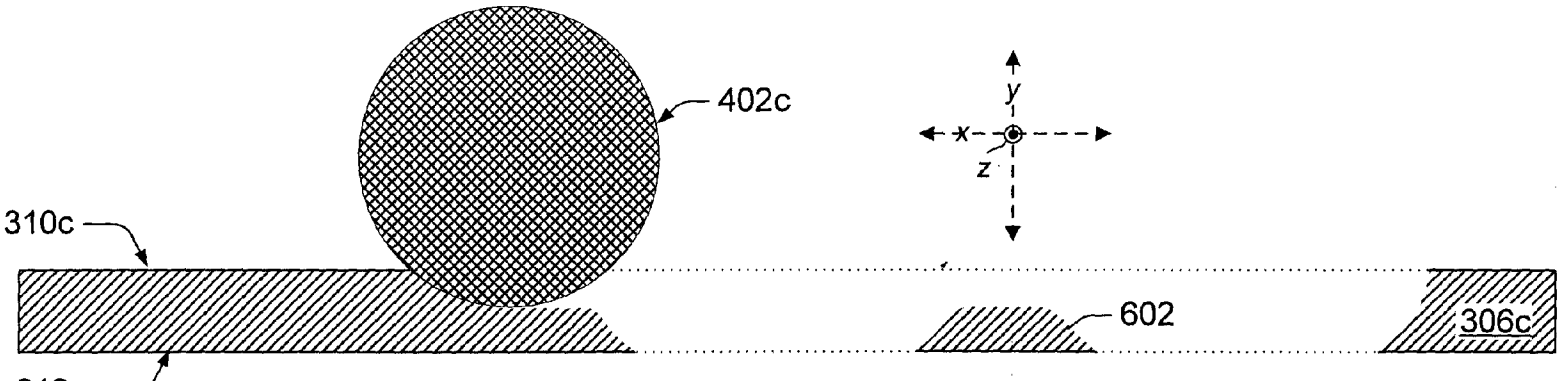
Figure 6B:
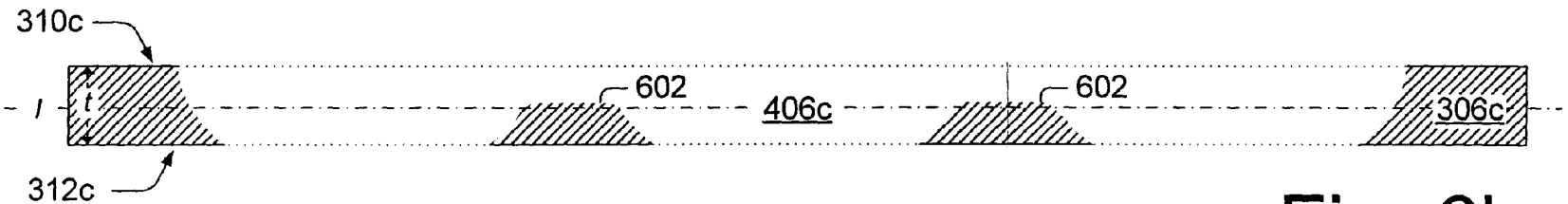
Figure 6C:
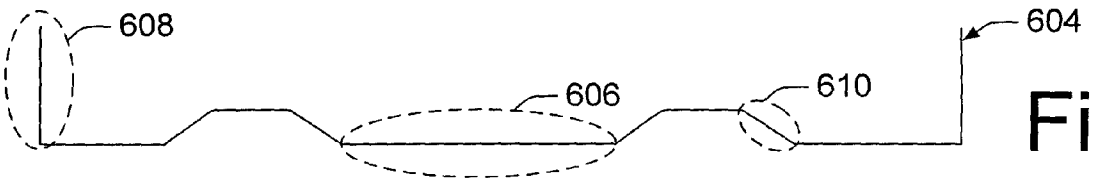
FIG. 6*c* illustrates an exemplary saw path in accordance with one exemplary embodiment.
Figure 7A:
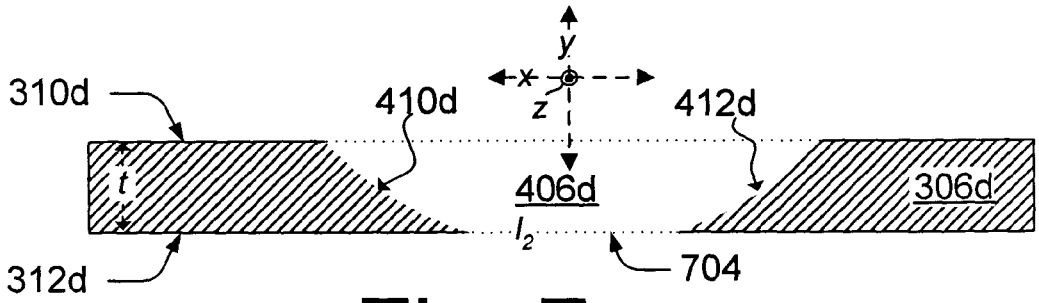

FIGS. 6*a*–6*c* illustrate a further embodiment where a saw 402*c* forms a feature 406*c* in a substrate 306*c*. In this embodiment, the feature has reinforcing substrate material or "ribs" 602 extending across the feature's long axis l. In this embodiment, ribs 602 extend from second surface 312*c* through a portion of the thickness t toward first surface 310*c*.

The embodiment shown in FIGS. 6*a*–6*b* can be formed by moving saw 402*c* along a vector which simultaneously has both x-axis and y-axis components For example, FIG. 6*c* shows one suitable saw path 604 for forming feature 406*c* shown in FIG. 6*b*. Saw path 604 includes movement along the x and y axes indicated as 606 and 608 respectively. Saw path 604 also includes movement along a vector that simultaneously has both x-axis and y-axis components. One such example is indicated generally at 610. Such a configuration can be achieved among other ways, by moving the saw at a constant velocity in the x direction and concurrently moving the saw in the y direction at desired intervals.

Though the features shown in FIGS. 4*a*–4*c*, 5*a*–5*d* and 6*a*–6*c* are illustrated as being cut with a circular saw, other exemplary features can be formed by one or more of sand drilling, laser machining, dry etching, wet etching, and mechanically cutting or abrading, among others. In some embodiments, once a feature is formed, additional substrate material can be removed to form a desired slot configuration. An example of one such process is described below in relation to FIGS. 7*a*–7*j*.

Figure 7B:
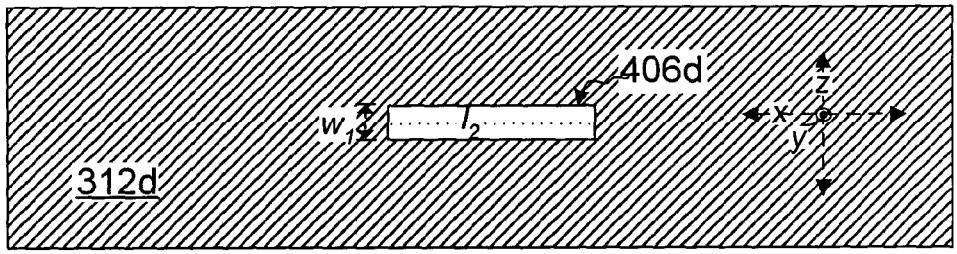
Figure 7C:
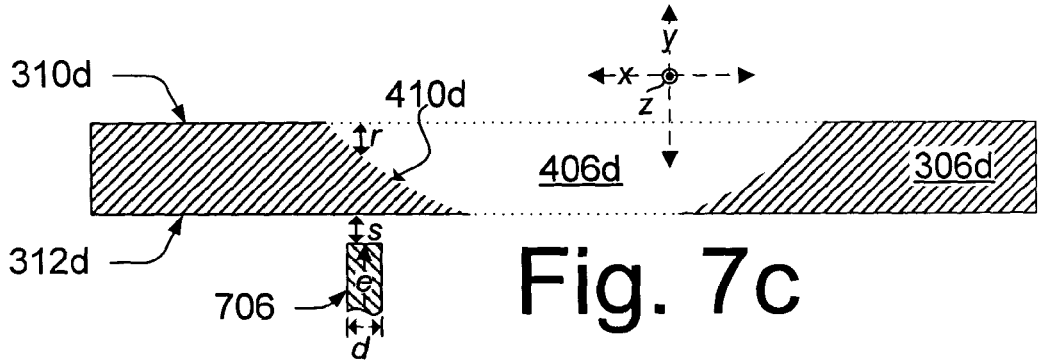

FIGS. 7*a*–7*b* illustrate cross-sectional and elevational views respectively of a substrate 306*d* having a feature 406*d* formed therein. FIG. 7*a* represents a cross-sectional view taken along a long axis of feature 406*d* in substrate 306*d* and orthogonal to the first surface 310*d*, while FIG. 7*b* shows a view of the second surface 312*d*. In this embodiment, as can best be appreciated from FIG. 7*a*, a feature 406*d* has a tapered elevational profile when viewed along the long axis.

In this embodiment, the tapered elevational profile is manifested in two tapered portions 410*d*, 412*d* of the profile. Other suitable embodiments can have more or fewer tapered portions. For example, FIG. 6*b* shows an embodiment with six tapered portions.

In this embodiment tapered portions 410*d*, 412*d* are curvilinear. Other suitable embodiments can have generally linearly tapered portions, among others. Other suitable embodiments can have other configurations.

In this embodiment, tapered portions 410*d*, 412*d* are separated by a region 704 that passes through the substrate's entire thickness t. Another embodiment can comprise a blind feature, no portion of which passes through the substrate's entire thickness.

In this embodiment, feature 406*d* has a generally uniform width $w_1$ extending through substrate 306*d* between first surface 310*d* and second surface 312*d*. In this embodiment, the width $w_1$ generally corresponds to the thickness of the saw blade used to cut the feature. Examples of suitable saw blades and respective dimensions are described above.

FIGS. 7*c*–7*j* illustrate a suitable technique for removing additional substrate material along the feature length to form a desired slot configuration.

Figure 7D:
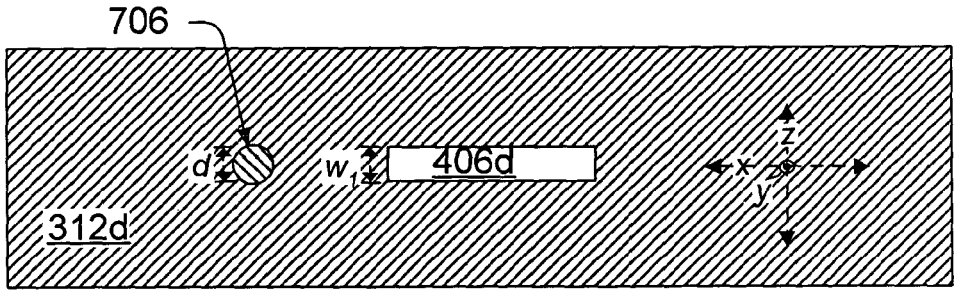

FIGS. 7*c*–7*d* illustrate a sand drill nozzle ("nozzle") 706 positioned proximate second surface 312*d*. A sand drill is one suitable means for delivering abrasive particles for removing substrate material. Any suitable abrasive particles can be utilized as should be recognized by the skilled artisan.

As can best be appreciated from FIG. 7*d*, nozzle 706 is positioned generally in line with feature 406*d*. Further, in this embodiment, the nozzle position corresponds generally to a point where tapered portion 410*d* defines a feature depth r that is approximately 100–150 microns. Other suitable embodiments may start the removal process with nozzle 706 in a different position. For example, one such embodiment may start the process with the nozzle positioned to correspond to a location where tapered portion 410*d* intersects with first surface 310*d*. Nozzle 706 can be positioned a distance indicated as s from second surface 312*d*. Distance s can range from about 1000 to about 5000 microns. In one embodiment, s is in a range of about 2000–2500 microns.

Nozzle 706 as shown here has a terminal end proximate to the substrate that is generally circular when viewed in a cross-section taken generally transverse to an ejection path e along which abrasive particles are ejected from the nozzle. In this particular embodiment, ejection path e is generally perpendicular to second surface 312*d*, though other suitable embodiments can utilize other non-perpendicular ejection paths.

As shown in FIG. 7*c*, feature 406*d* has an elevational thickness at a point measured orthogonally between nozzle 706 and the first surface 310*d* comprising the substrate's thickness t minus the feature depth r. If nozzle 706 is repositioned to a point on the feature having a different feature depth, the elevational thickness will change accordingly.

Though a circular configuration of nozzle 706 is shown here, other suitable nozzles can have a square, rectangular or elliptical configuration among others. Nozzle diameter d can approximate feature width $w_1$ and/or a desired slot width. For example, in this embodiment, width $w_1$ is approximately 180 microns, and diameter d is about 200 microns. In other examples, nozzle diameter can be any practical range, with non-limiting examples ranging from less than 100 microns to more than 1000 microns.

FIGS. 7*e*–7*f* illustrate substrate 306*d* with additional substrate material removed by abrasive particles ejected from nozzle 706. Nozzle 706 has been moved from a first position shown in FIGS. 7*c*–*d* to a new second position to eject abrasive particles. Examples of suitable nozzle movement will be discussed in more detail below.

FIGS. 7*g*–7*j* illustrate substrate 306*d* after additional substrate material has been removed by abrasive particles ejected from nozzle 706. The combination of removing substrate material to form the feature and the removal of additional substrate by particles from the sand drill nozzle forms a slot 304*d*. In this particular e mbodiment, an essentially uniform width $w_2$ is maintained at second surface 312*d*. Other suitable embodiments may have a slightly greater width $w_3$, $w_4$ at slot end regions 730, 732 respectively, than a width $w_5$ in a mid-region 734 when measured orthogonal to the long axis at second surface 312*d*. Previous technologies created a width in the mid-region 734 that is wider than at the slot end region 730, 732. Slots that are wider at the mid-region can limit how closely the slots can be positioned relative to one another on the substrate and/or result in cracking in substrate material extending between two adjacent slots.

FIG. 7*i* shows a top view of first surface 310*d*, while FIG. 7*j* shows a cross-sectional view taken transverse the long or x-axis. Slot 304*d* maintains a generally uniform width $w_1$ along the long axis at first surface 310*d*. Maintaining a generally uniform slot width at the first surface can allow slots to be positioned closer together on the substrate. When measured at the first surface, previous sand drilling technologies tended to have a greater slot width in the mid-region than the slot end regions. Slots with wide mid-regions can lead to cracking and of the substrate and can adversely affect positioning of components such as the firing chambers relative to the slot.

As can be best be appreciated from FIG. 7*j*, in this embodiment the width $w_1$ is also the minimum slot width on substrate 306*d*. Maintaining a more uniform minimum slot width along the length of the slot may contribute to printer performance by, among other reasons, providing more uniform ink flow to the various firing chambers, shown FIG. 3, supplied by slot 304*d*.

Referring again to FIG. 7*g*, in this embodiment slot 304*d* is defined, at least in part by two endwalls 720*a*, 720*b*. In this particular embodiment each endwall 720*a*, 720*b* comprises a first endwall portion 722*a* and 722*b* respectively, proximate to first surface 310*d*, and a second endwall portion 724*a* and 724*b* respectively, proximate second surface 312*d*. In other suitable embodiments, the endwalls may not have readily discernable endwall portions. Such an example is shown in FIG. 10*a*.

In some embodiments, substrate material can be removed while generally maintaining the width of the existing feature. For example, in this embodiment, the removal technique increases the feature length (FIG. 7*a*) at the substrate's second surface 312*d* while essentially maintaining the feature width. In this example, length $l_2$ shown in FIGS. 7*a*–7*b* is increased to $l_3$ shown in FIG. 7*g* while generally maintaining the width $w_1$. Other suitable embodiments may utilize the described technique to smooth and/or polish a feature without significantly increasing the width or length.

In some embodiments, where slot 304*d* is formed as described above by forming a feature and then utilizing abrasive particles to remove additional substrate material, stress concentrations on particular regions of the substrate material can be reduced. Such stress reduction can be due to smoothing rough or prominent portions which could otherwise become crack initiation points. Further, some slots formed in this manner have a configuration where the slot is defined, at least in part, by substrate material at the slot ends which defines an angle of approximately 90 degrees or greater. One such example can be seen in FIG. 7*g* where angle θ extends through the substrate between second surface 312*d* and endwall portion 724*a* and angle δ extends through the substrate between second surface 312*d* and endwall portion 724*b*. As illustrated in FIG. 7*g*, for example, angle θ is approximately 110 degrees, and angle δ is approximately 110 degrees. In some embodiments, such a configuration can further reduce stress concentrations.

Figure 8:
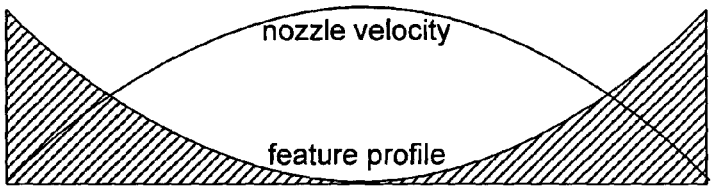
FIG. 8 represents a graph of nozzle movement in accordance with one exemplary embodiment.

During the substrate removal process, nozzle 706 may be moved incrementally and/or generally continuously relative to the substrate 306*d* to remove a desired amount of substrate material. Alternatively or additionally, the substrate may be moved relative to the nozzle. In one example, the nozzle is positioned proximate a first area of the substrate to remove a desired amount of substrate material. Once the substrate material is removed, the nozzle is repositioned to a second different position to remove additional substrate material. Other embodiments continually move the nozzle, but adjust the rate of movement to correspond to an amount of substrate material to be removed. In some embodiments, the nozzle speed can correlate and/or be proportional to an elevational thickness of the substrate remaining after feature formation. FIG. 8 shows one embodiment where nozzle speed is generally inversely proportional to the elevational thickness along the feature profile.

In this embodiment, the duration of exposure of a given region of the substrate's second surface to abrasive particles is adjusted to correspond to an amount of substrate material which is desired to be removed. In other words, a slower nozzle speed removes more substrate material, while a higher nozzle speed removes less substrate material. As such, a slower nozzle speed may be utilized in a region with a greater elevational thickness, and a higher nozzle speed with a lesser elevational thickness. Alternatively or additionally to adjusting nozzle speed, other exemplary embodiments may adjust other removal conditions to compensate for changes in the elevational thickness. For example, some embodiments can move the nozzle at a constant speed but vary other removal conditions such as the velocity at which the abrasive particles are ejected. Still other examples may adjust particle size and/or the amount of abrasive particles delivered per unit time, among others, to compensate for changes in the elevational thickness.

Figure 9:
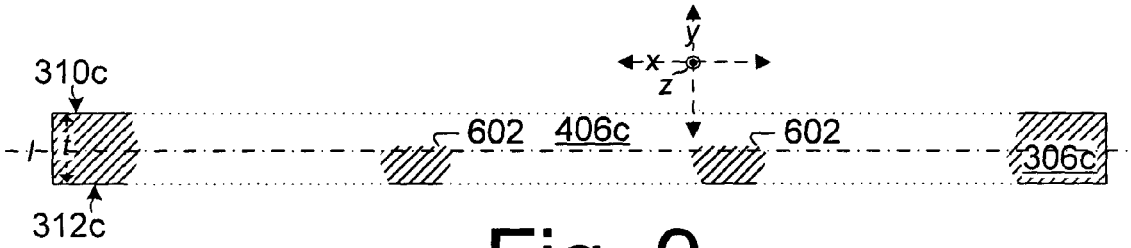
FIG. 9 illustrates a cross-sectional view of a portion of an exemplary substrate in accordance with one exemplary embodiment.

FIG. 9 is a side-sectional representation which shows another application for the described abrasive particle removal process. In this embodiment, abrasive particles removed additional material from substrate 306*c* as shown i n FIG. 6*b* to form a desired slot configuration. Such a slotted substrate 306*c* can combine the slot profile described in relation to FIGS. 7*g*–7*j* with the ribs 602 described above in relation to FIG. 6*b*. The ribs 602 can contribute to a stronger slotted substrate than slots of comparable length which lack such ribs. The exemplary abrasive particle removal process can configure this remaining substrate material with endwall-to-substrate surface angles o f approximately 90-degrees or greater as described above in relation to FIGS. 7*g*–7*h*. The configuration shown here can be scaled to any desired slot length by increasing the number of ribs 602 positioned across the slot with increasing slot length.

In addition to the embodiments described above, the exemplary abrasive particle removal process can be utilized in other applications to remove additional substrate material to form a desired slot configuration. One such example can be seen in FIGS. 10 and 10*a*.

Figure 10:
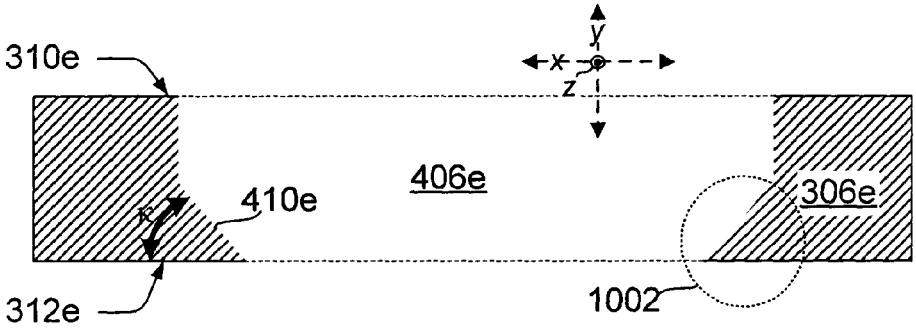
FIGS. 10–10*a* illustrate cross-sectional views of a portion of an exemplary substrate in accordance with one exemplary embodiment.
Figure 10A:
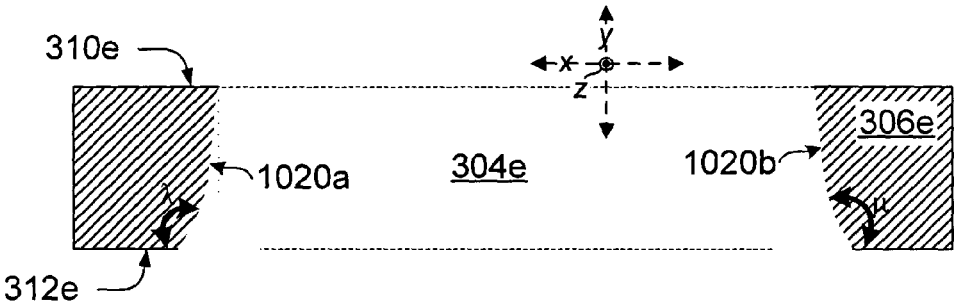

FIG. 10 illustrates a cross-sectional view taken along a long axis of a feature 406*e* formed in a substrate 306*e*. In this particular embodiment, feature 406*e* comprises a slot having a tapered elevational profile comprising a reentrant profile relative to second surface 312*e* as noted by acute angle κ. A reentrant portion is indicated generally at 1002. In this example, feature 406*e* having tapered portion 410*e* is etched into the substrate.

FIG. 10*a* illustrates substrate 306*e* after abrasive particles removed additional substrate material to form a slot 304*e* having a desired configuration. In this particular embodiment, abrasive material was selectively directed only at those areas of the substrate proximate to the slot where substrate material was desired to be removed. Such a selective removal process allows the slot as defined by endwalls 1020*a*, 1020*b* to form angles λ, μ of 90 degrees or greater relative to second surface 312*e*. A slot having this desired configuration can be less prone to cracking, while generally maintaining a uniform slot width.

The described embodiments have shown only steps that remove material in the slot formation process. Other exemplary embodiments can also have steps which add material. For example, a cut can be made into the substrate followed by a deposition step and then the exemplary abrasive particle removal process can be utilized to finish the slot.

The described embodiments can provide methods and systems for forming slots in a substrate. The slots can be formed, among other ways, by making a saw cut to form a feature and then removing additional substrate material using an abrasive particle removal process. The slots can be inexpensive and quick to form. They can be made as long as desired and have beneficial strength characteristics that can reduce die fragility and allow slots to be positioned close together.

Although various embodiments have been described in language specific to structural features and methodological steps, it is to be understood that the appended claims are not necessarily limited to the specific features or steps described. Rather, the specific features and steps are disclosed as preferred forms of implementation.

What is claimed is:

1. A method comprising:

making a cut into a first surface of a substrate using a cutting disk having a generally planar surface that is oriented generally perpendicular to the first surface;

first directing abrasive particles toward a first portion of a second generally opposite surface of the substrate to remove substrate material; and, after said first directing, second directing abrasive particles toward a second different portion of the second generally opposite surface of the substrate to remove additional substrate material, wherein said first directing and said second directing, in combination with said making a cut, form a slot.

2. The method of claim 1, wherein said act of making and said acts of directing form the slot which is defined, at least in part, by two generally opposing endwalls each of which form an angle of at least 90 degrees measured through the substrate and relative to the second surface.

3. The method of claim 1, wherein said act of making comprises making a cut between two generally linear arrays of firing resistors positioned over the substrate.

4. The method of claim 1, further comprising after said acts of making and directing, positioning an orifice plate over the first surface.

5. A method comprising:

cutting substrate material with a circular saw positioned relative to a first surface of a substrate; and, removing additional substrate material from a second generally opposite surface of the substrate by moving a sand drill nozzle along the substrate while ejecting abrasive particles therefrom, wherein said acts of cutting and removing form a slot through the substrate.

6. The method of claim 5, wherein said act of moving comprises moving a sand drill nozzle having a terminal end through which the abrasive particles are ejected along a path, the terminal end having a generally square cross section taken transverse the path.

7. The method of claim 5, wherein said act of moving comprises moving a sand drill nozzle having a terminal end through which the abrasive particles are ejected along a path, the terminal end having a generally circular cross section taken transverse the path.

8. The method of claim 5, wherein said act of cutting forms a tapered elevational profile in the substrate.

9. The method of claim 5, wherein the first surface and the second surface define a thickness therebetween, and wherein said act of cutting cuts through the entire thickness of at least a portion of the substrate.

10. The method of claim 5, wherein said act of cutting comprises moving the circular saw along a vector simultaneously having a component in a first direction substantially perpendicular to the first surface and a component in a second direction substantially parallel to the first surface.

11. The method of claim 5, wherein said cutting comprises making multiple passes with the circular saw.

12. A method comprising:

cutting substrate material by moving a circular saw toward a substrate from a first direction; and, removing additional substrate material from the substrate by moving a sand drill nozzle along the substrate while ejecting abrasive particles from the sand drill in a second direction which is generally opposite to the first direction, wherein the cutting and removing form a desired slot through the substrate.

* * * * *